US006247617B1

(12) United States Patent
Clyde et al.

(10) Patent No.: US 6,247,617 B1
(45) Date of Patent: Jun. 19, 2001

(54) SINGLE USE CONTAINER FOR DISPENSING SEPARATELY HOUSED STERILE COMPOSITIONS

(76) Inventors: Richard Allen Clyde, 1825 N. Stewart St., Kissimmee, FL (US) 34746; Steven Frank Simmons, 1104 Cirrus Ct., Orlando, FL (US) 32835

( * ) Notice: Subject to any disclaimer, the term of this patent is extended or adjusted under 35 U.S.C. 154(b) by 0 days.

(21) Appl. No.: 09/459,709

(22) Filed: Dec. 13, 1999

(51) Int. Cl.[7] ..... B65D 35/00
(52) U.S. Cl. ..... 222/94; 222/541.9
(58) Field of Search ..... 222/94, 145.1, 222/541.1, 541.6, 541.9

(56) References Cited

U.S. PATENT DOCUMENTS

| | | | | |
|---|---|---|---|---|
| 1,626,338 | | 4/1927 | Heublein . | |
| 1,928,998 | | 10/1933 | Kovacs . | |
| 2,166,307 | | 7/1939 | Libby . | |
| 2,517,027 | | 8/1950 | Rado | 222/94 |
| 2,663,461 | | 12/1953 | Brown . | |
| 3,197,071 | | 7/1965 | Kuster | 222/94 |
| 3,221,939 | | 12/1965 | Brown . | |
| 3,224,640 | * | 12/1965 | Schneider et al. | 222/94 |
| 3,227,319 | * | 1/1966 | Rosier | 222/94 |
| 4,073,406 | | 2/1978 | Goncalves . | |
| 4,548,606 | | 10/1985 | Larkin . | |
| 4,591,357 | | 5/1986 | Sneider . | |
| 4,687,663 | * | 8/1987 | Schaeffer | 222/94 |
| 4,838,457 | | 6/1989 | Swahl et al. . | |
| 4,872,872 | | 10/1989 | Polak . | |
| 4,903,842 | | 2/1990 | Tokuda et al. . | |
| 5,052,590 | | 10/1991 | Ratcliff | 222/94 |
| 5,114,044 | | 5/1992 | Spanek et al. . | |
| 5,114,411 | | 5/1992 | Haber et al. . | |
| 5,154,917 | | 10/1992 | Ibrahim et al. . | |
| 5,207,509 | | 5/1993 | Herbert . | |
| 5,244,120 | | 9/1993 | O'Meara | 222/94 |
| 5,269,441 | | 12/1993 | O'Meara | 222/94 |
| 5,316,400 | | 5/1994 | Hoyt et al. . | |
| 5,318,203 | | 6/1994 | Iaia et al. | 222/94 |
| 5,409,125 | | 4/1995 | Kimber et al. . | |
| 5,411,176 | | 5/1995 | Favre | 222/94 |
| 5,462,526 | | 10/1995 | Barney et al. . | |
| 5,494,190 | | 2/1996 | Boettcher . | |
| 5,509,898 | | 4/1996 | Isono et al. | 604/87 |
| 5,577,636 | | 11/1996 | Fukuoka et al. | 222/94 |
| 5,716,338 | | 2/1998 | Hjertman et al. . | |
| 5,725,499 | | 3/1998 | Silverstein et al. | 604/82 |
| 5,836,922 | | 11/1998 | Hansen et al. . | |
| 5,881,869 | | 3/1999 | Hudson | 206/219 |
| 5,897,833 | * | 4/1999 | Hunt et al. | 222/145.1 |

* cited by examiner

*Primary Examiner*—J. Casimer Jacyna
(74) *Attorney, Agent, or Firm*—McDermott, Will & Emery

(57) ABSTRACT

A single use container for accurately dispensing separately housed sterile compositions with minimal contact to non-sterile surfaces of the container is disclosed. Embodiments include a container having a first and second chamber within the container for housing a first and second sterile composition. Each chamber has an angled channel which defines an axis for directing the sterile composition from their respective chambers. The angled channels are directed toward each other and are so angled as to minimize contact of the escaping sterile compositions with a non-sterile surface of the container, e.g. the tip. A plurality of tear-off closures seal the angled channels to prevent the sterile compositions from escaping from their respective chambers and a tab portion is provided joining the plurality of closures. Removing the tab portion causes all of the solid closures to be removed in a single action.

14 Claims, 3 Drawing Sheets

SINGLE USE CONTAINER FOR DISPENSING SEPARATELY HOUSED STERILE COMPOSITIONS

FIELD OF THE INVENTION

The present invention relates to a container for dispensing separately housed compositions, and more particularly to a single use container for dispensing sterile compositions.

BACKGROUND OF THE INVENTION

The field of packaging systems which store a single dosage of medicated compositions have become of importance and interest in the pharmaceutical industry. There are many such devices, and recently interest has focused on those applications in which two or more ingredients and/or diluents are kept separate from one another in a single container, such as in a multi-chambered container. Prepackaging of specific doses or quantities is important to save time during the application of medicines or nutritional compositions which need to be mixed promptly and in precise ratios and administered in accurate dosages.

Potent drugs which rapidly deteriorate when mixed together invariably require that they be housed separately. To facilitate the accurate and timely dispensing of the needed drug, single dosage containers having a plurality of separately stored active components and/or diluents are particularly advantageous. Moreover, single use containers tend to facilitate the sterile administration of medication by eliminating the potential contamination often associated with multiple dose containers.

Devices providing separate compartments in a single container for separately storing different medicinal components are described, for example, in U.S. Pat. Nos. 4,545,606 to Larkin and 5,207,509 to Herbert. These containers, however, require elaborate operation and additional external devices for their use. Moreover, these containers store multiple dosages which, upon repeated dispensing, may lead to contamination of the contents.

Multicomponent container systems which prevent users from only dispensing one component is described in U.S. Pat. No. 5,881,869 to Hudson. Conventional devices, however, suffer from the drawback in that they do not recognize contamination can potentially occur during dispensing of the components.

U.S. Pat. Nos. 5,244,120 and 5,269,441 both to O'Meara disclose dual chamber medicant dispensers. These devices are deficient in not being able to either accurately deliver the entire contents of the container or effectively prevent the contents of the container from contacting a non-sterile surface.

Accordingly, a continuing need exists for a single-use container that separately stores sterile compositions which can be easily and accurately dispensed from the container. A further continuing need exists for a container that can dispense the contents thereof without contamination being caused by contact with non-sterile surfaces of the container.

SUMMARY OF THE INVENTION

An advantage of the present invention is a single use container for accurately dispensing separately housed sterile compositions which prevents contact with non-sterile surfaces.

Additional advantages and features of the invention will be set forth in part in the description which follows and in part will become apparent to those having ordinary skill in the art upon examination of the following or may be learned from the practice of the invention. The advantages of the invention may be realized and obtained as particularly pointed out in the appended claims.

According to the present invention, the foregoing and other advantages are achieved in part by a single use container for dispensing separately housed sterile compositions and for minimizing, or all together avoiding, contact of the sterile compositions with a non-sterile surface of the container. In accordance with the present invention, the container comprises: a first chamber within the container for housing a first sterile composition having a first angled channel for directing the first sterile composition from the first chamber and a second chamber within the container for housing a second sterile composition having a second angled channel for directing the second sterile composition from the second chamber, wherein the first and second angled channels are directed toward each other.

In accordance with the present invention, the first and second angled channels are so sized and angled with respect to each other as to minimize or avoid contact of the escaping sterile compositions with any non-sterile surface of the container. In an embodiment of the present invention, the angled channels form an angle of less than about 180 degrees, e.g., no greater than about 60 degrees.

The chambers of the present invention house free flowing sterile compositions. The chambers can individually hold a volume of about 0.25 cubic centimeters (cc) to about 10 cc and can store a pharmaceutically active composition in one chamber and a pharmaceutically acceptable diluent in another chamber, or two or more pharmaceutically acceptable compositions in two or more chambers.

The container further comprises a plurality of tear-off solid closures sealing the angled channels to prevent the sterile compositions from escaping from their respective chambers and a tab portion joining the plurality of tear-off solid closures. In practicing the invention, removing the tab portion causes all of the solid closures to be removed in a single action thereby assuring opening all of the chambers. Removing the tab portion further permits the sterile compositions housed in their respective chambers to escape through their respective angled channels and combine at a point distal from the container, wherein the first and second angled channels form an angle which prevents the combined compositions from substantially contacting an outer, non-sterile surface of the container and prevents contamination to the sterile compositions.

Another aspect of the present invention is a single-use container comprising: a first chamber within the container for housing a first composition and having a first passage means for directing the first composition from the first chamber; a second chamber within the container for housing a second composition and having a second passage means for directing the second composition from the second chamber; and tear-off means for sealing the passages to prevent the compositions from escaping their respective chambers.

Additional advantages of the present invention will become readily apparent to those skilled in this art from the following detailed description, wherein only the preferred embodiment of the present invention is shown and described, simply by way of illustration of the best mode contemplated for carrying out the present invention. As will be realized, the invention is capable of other and different embodiments, and its several details are capable of modifications in various obvious respects, all without departing from the present invention. Accordingly, the drawing and description are to be regarded as illustrative in nature, and not as restrictive.

DESCRIPTION OF THE DRAWINGS

The various features and advantages of the present invention will become more apparent and facilitated by reference to the accompanying drawings, submitted for purposes of illustration and not to limit the scope of the invention, where the same numerals represent like structure and wherein.

DETAILED DESCRIPTION OF THE INVENTION

The single-use containers of the present invention comprise a plurality of chambers storing compositions and a plurality of passage means for directing the composition from their respective chambers to a point distal from the container. The directing means prevents the dispensed compositions from substantially contacting an outer, non-sterile surface of the container and prevents contamination to the compositions. The single-use containers further comprise tear-off means for sealing the passages to prevent the compositions from escaping their respective chambers. The tear-off means can include a means for joining the sealing means.

According to the present invention, a container is provided comprising a plurality of sealed chambers holding dispensable materials for a single use application. The expression "single-use" refers herein to mean broadly, a container that stores or houses a material to be substantially or completely dispensed or expelled from the container upon opening the container. Such single-use containers may contain material present in a predetermined or metered amount for administration of a single-dose of a pharmaceutically active composition, such as a bronchodilator solution.

The container of the present invention comprises a plurality of chambers having angled channels. The angled channels are sized and angled with respect to each other so that when the contained materials are dispensed, droplets or other accumulation of the dispensed material do not form on any non-sterile surface of the container, i.e., at the tip or at an outer surface near the angled channels.

In accordance with the present invention, the angled channels are each sealed by a tear-off closure, i.e. a non-reconnectable solid closure or portion, such as a solid "B—B" type closure. The solid closures advantageously maintain all of the stored material in the chamber, in contrast to, for example, a hollow tip which would encourage some of the stored material to be maintained in the tip. Having all of the stored material contained in the chamber promotes the consistent delivery of an accurate dose, as opposed to a hollowed tip or closure which may cause fluctuations between administration of the contents due to some of the materials remaining in the tip of a dispensed composition.

The container further comprises a tab portion, i.e., a tear-off tab, which can be easily grasped, as by human fingers, for removing the solid closures in a single action. The tab portion advantageously joins all of the solid closures sealing the chambers so that removal of the tab portion results in the removal of all joined solid closures. The removal of solid closures in a single action, and the consequent opening of all of the passages, advantageously promotes dispensing the stored materials contained in all of the chambers, thereby avoiding the improper administration of less than all of the stored materials.

Figure 1:
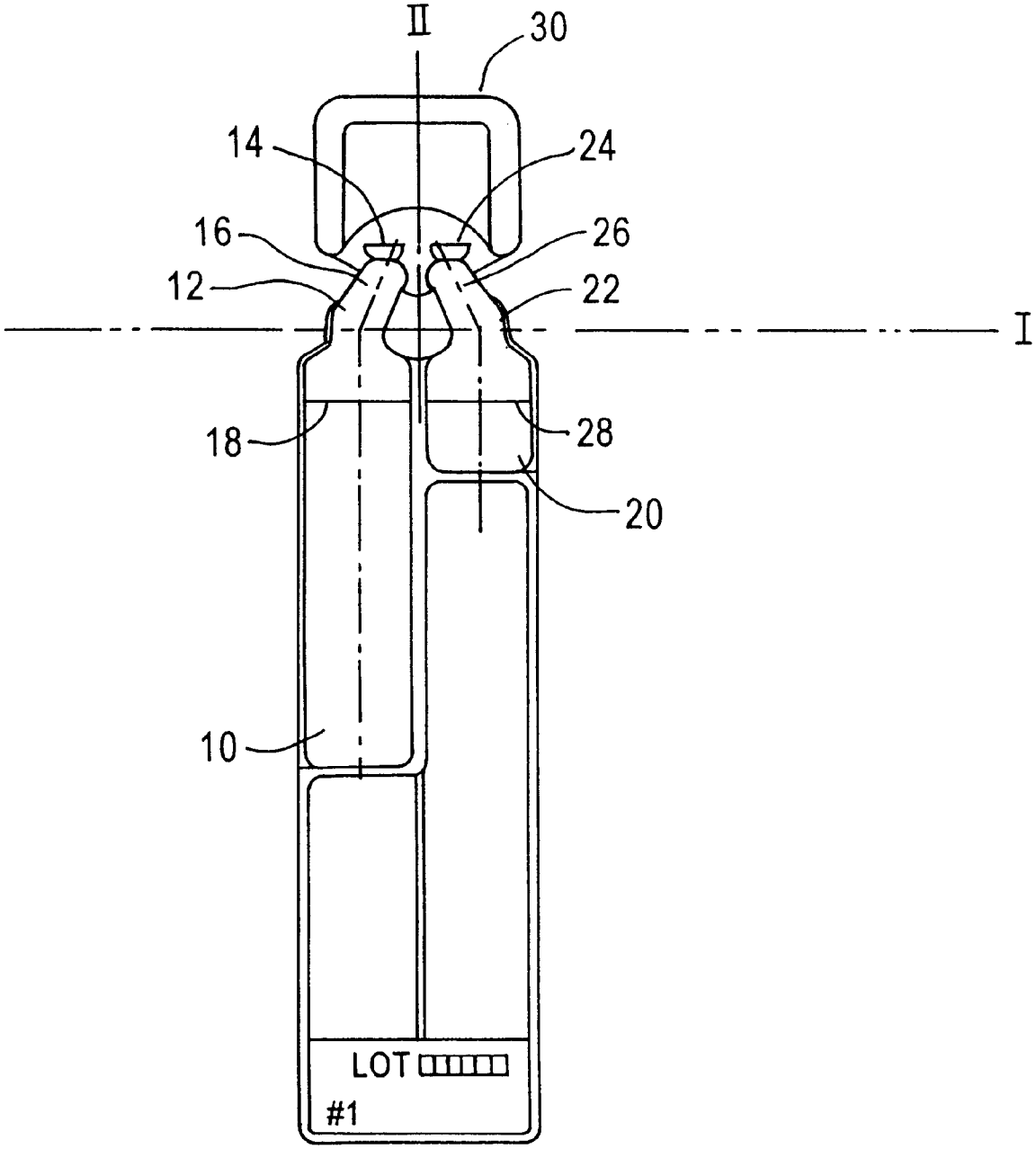
FIG. 1 is a front view of a single use container according to the present invention.
Figure 2:
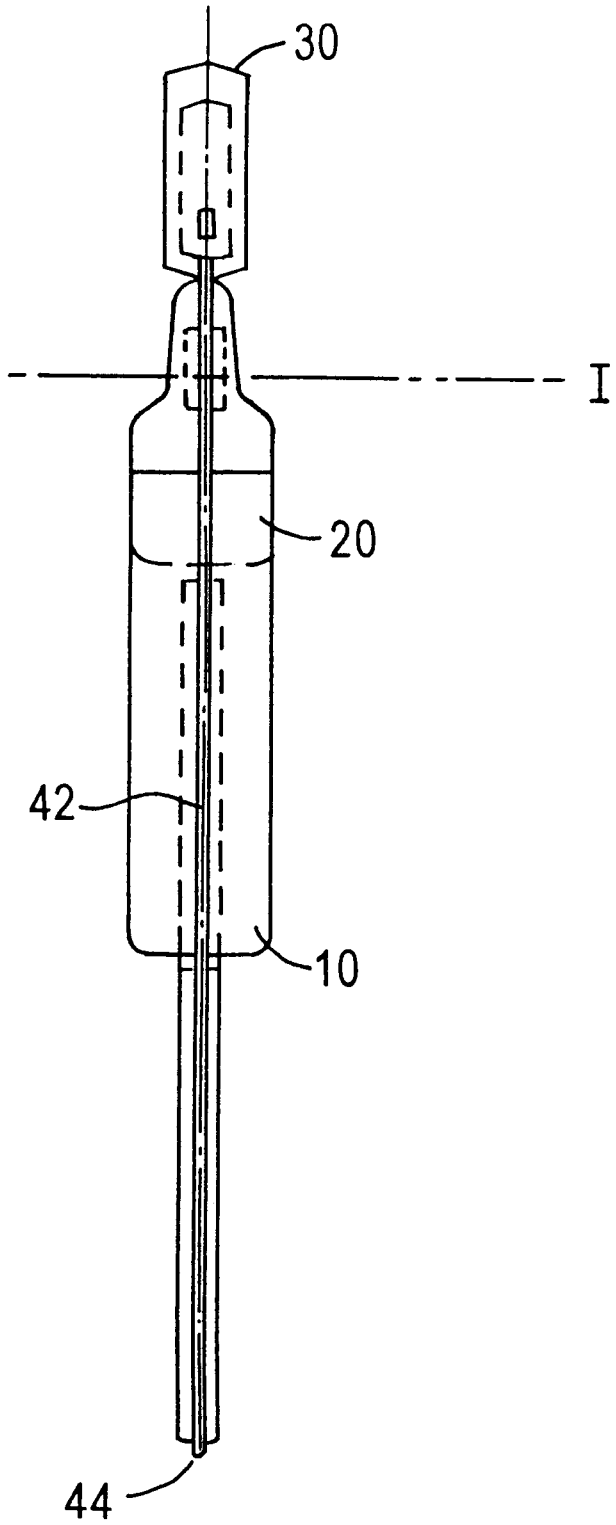
FIG. 2 is a side view corresponding to FIG. 1 along line I of FIG. 1.
Figure 3:
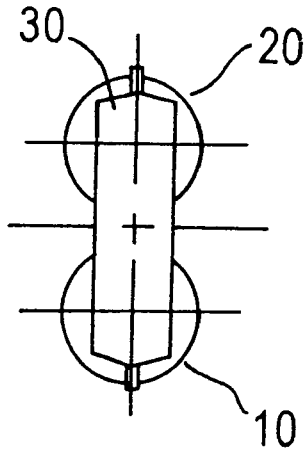
FIG. 3 is a top view corresponding to FIG. 1 along line II of FIG. 1.

In FIGS. 1–3, a single use container according to an embodiment of the present invention is illustrated. As shown, container 8 comprises a first chamber 10 and a second chamber 20. Chambers 10 and 20 can contain any practical volume and the volume depends on the particular intended application. For example, chambers 10 and 20 can hold compositions up to about 50 cc for dilute compositions or can contain less than about 1 cc for concentrated compositions. The chambers can have the same volume or the first chamber can contain a different volume from the second chamber. In an embodiment of the present invention, the first and second chambers individually house a volume of about 0.25 cc to about 10 cc.

First chamber 10 has angled channel 12 sealed by solid closure 14 and second chamber 20 has angled channel 22 sealed by solid closure 24. Joining solid closures 14 and 24 is tab portion 30. Further illustrated in FIG. 1, is axis 16 defined by first channel 12 of first chamber 10 and axis 26 defined by second angled channel 22 of second chamber 20.

The container of the present invention can include additional chambers for housing additional compositions. For example, the container of the present invention can further comprise a third chamber within the body for containing a third sterile composition, wherein the third chamber has a third angled channel for directing the third sterile composition from the third chamber.

In an embodiment of the present invention, the multi-chambered container will be formed from two opposing sheets of sterilizable materials, such as a flexible polymer, e.g., polyamides, polyesters, polyethers, polyurethanes, polyolefins, random or block copolymers thereof, or blends thereof. In an embodiment of the present invention, the container is made of a flexible polyolefin, such as polyethylene sheets. These sheets will be sealed along seal lines 42 and 44, as shown in FIG. 2.

The container of the present invention can be sterilized prior to, during, or after filing chambers 10 and 20 with the intended dispensable materials. The intended dispensable materials can be sterilized prior to, during, or after they are deposited in the container or any combination thereof, to manufacture the single use container housing sterile compositions. The chambers can be filled with one or more compositions comprising pharmaceutically active formulations, vitamins, or nutritional preparations with or without carriers that are preferably administered as sterile compositions. The chambers can further be separately filled with pharmaceutically acceptable carriers, i.e., diluents. It is understood that the compositions can be homogeneous solutions, formulations or heterogeneous admixtures with different active ingredients separately housed in the chambers or the same compositions housed in the different chambers. Providing the same composition in separate chamber advantageously allows dispensing an accurate single use of the composition without substantial contact of the composition with non-sterile surfaces. Thus, while the multi-chambered container can store different composition, it is not so limited.

The packaging system of the present invention has particular application in the medical arts where it is desired to mix two or more compositions solely at the time of use. In an embodiment of the present invention, the first chamber is filled with about 0.5 milliliter (mL) of an Albuterol Sulfate inhalation solution comprising about 0.5 weight percent (wt %) of the active agent and the second chamber is filled with about 2.5 mL of an Ipratropium Bromide inhalation solution comprising about 0.02 wt % of the active agent. In an embodiment of the present invention, each chamber individually contains a volume of about 0.25 cubic centimeter to about 10 cubic centimeters.

While the present container 10 can hold liquids in the compartments, it is obvious that the container is usable with any fluid material. For example, a liquid could be placed in compartment 10 up to the fill line shown as 18 as well as in compartment 20 up to fill line 28, as shown in FIG. 1. Further, while the present container system has been described for use with fluid materials in the health care field, it will be appreciated that the compartmented container system can be applied to other fields. It should further be understood that the term "composition" as employed in the specification or claims is meant to imply any medicament or diluent material which will flow freely from the respective compartments, whether a liquid, or free flowing non-liquid.

The various features and advantages of the present invention will become more apparent and facilitated by a description of its operation. As described above, the present inventive container comprises non-resealable channels which are closed by solid closures to prevent sterile compositions from escaping their respective chambers. A tab portion is provided to join the plurality of solid closures. The tab portion can encase the solid closures or can be simply attached thereto. The tab portion is shaped such that it can be grasped between the fingers of a user.

The solid closures can be scored or fractured along or between the angled channel, which they seal. Alternatively, or in combination, the material sealing and adjoining the closures to the channels can be thinned or otherwise less resistant to tearing so that the solid closures easily separate from the channel when the tab portion is removed.

Figure 4:
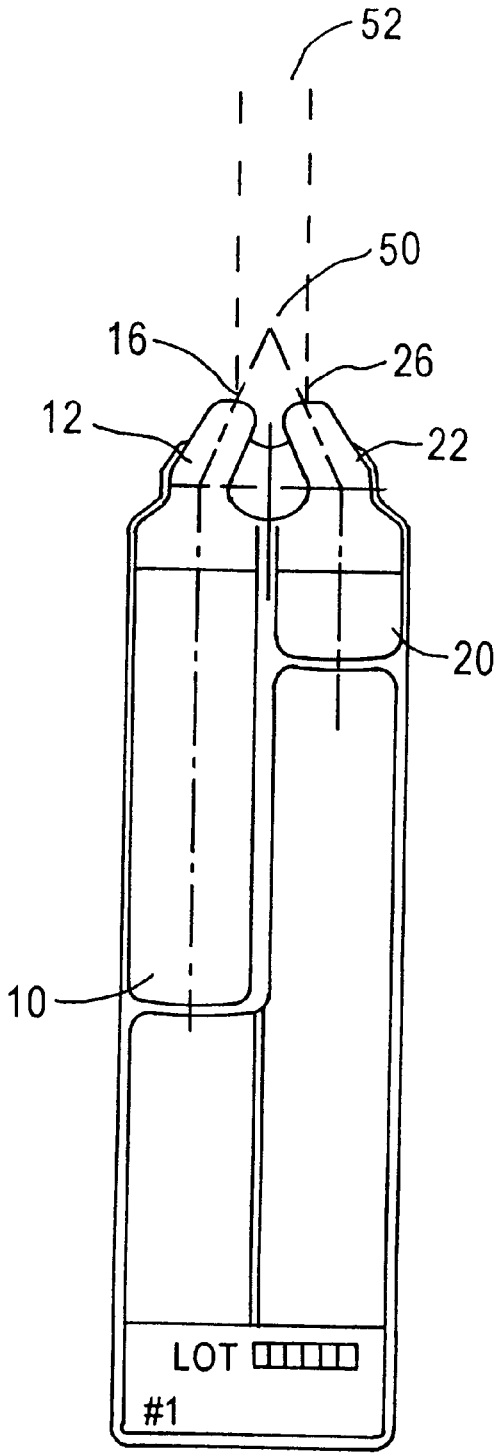
FIG. 4 is a front view corresponding to FIG. 1 with the tab portion removed.

Dispensing the housed sterile compositions can be performed by removing the tab portion together with the solid closures attached thereto as, for example, by manually separating the tab portion from the body of the container causing all of the solid closures to be removed along with the tab portion resulting in an open container as shown in FIG. 4. Thus, the present inventive container facilitates opening all of the chambers in a single action thereby preventing the administration of fewer than all of the compositions in the chambers by an inexperienced or non-attentive user.

Once the tab portion is removed (i.e. the angled channels are opened), a passageway leading from the chamber to the exterior of the container is provided. In accordance with the present invention, the angled channels are directed toward each other such that they form an angle with respect to each other. In an embodiment of the present invention, the channels form an angle of less than about 180 degrees, e.g., no greater than about 60 degrees. As illustrated in FIG. 4, angled channel 12 defines axis 16 which extends from chamber 10 and angled channel 22 defines axis 26 extending from chamber 20. The axes correspond, generally, to the flow path of the compositions upon expulsion from the chambers to a point distal from the container. Shown in FIG. 4 as point 50. The axes further corresponds to the angle formed by the angled channels with respect to each other. As shown in the embodiment of FIG. 4, the angled channels form an angle of about 20 degrees.

In accordance with the present invention, the angle channels can be so sized and separated so that when the stored materials are dispensed from their respective chambers they merge forming a stream away from the container, rather than accumulate on non-sterile surfaces of the container. For example, the diameter of the angled passages can be varied so that the points defined by at the downstream ends thereof can be sized with respect to the materials being ejected so that droplet formation tends to be inhibited and the possibility of contamination fully attenuated.

In an embodiment of the present invention, the downstream ends of the angled channels are separated by a distance of about 0.01 centimeter (cm) to about 2 cm from each other so that droplet formation is prevented. In an embodiment of the present invention, the distance 52 between the angled channels is about 0.4 cm.

Orienting the channels downwardly allows the sterile compositions housed in their respective chambers to escape through their angled channels along their respective axes and combine at a point distal from the container. The angled channel prevents drops or other accumulation of the stored compositions from forming on the tip of the container as the compositions exit the container thereby preventing the compositions from contacting non-sterile surfaces, e.g. the outer tip and/or the outer walls of the container.

The present invention is applicable to various and obvious modifications. The present invention provides a manually operable multi-chambered container which is easily utilized and manufactured. The container system of this invention affords a sterile environment for compositions and for preventing the escaping compositions from substantially contacting an outer, non-sterile surface of the container. Activation of the system is readily accomplished without the use of additional components with the container.

Only the preferred embodiment of the present invention and an example of its versatility is shown and described in the present disclosure. It is to be understood that the present invention is capable of use in various other combinations and environments and is capable of changes or modifications within the scope of the inventive concept as expressed herein.

What is claimed is:

1. A single use container for dispensing separately housed sterile compositions and for minimizing contact of the sterille compositions with a non-sterile surface of the container, the container comprising:

a first chamber within the container for housing a first sterile composition having a first angled channel for directing the first sterile composition from the first chamber;

a second chamber within the container for housing a second sterile composition having a second angled channel for directing the second sterile composition from the second chamber, wherein the first and second angled channels are directed toward each a plurality of tear-off solid closures sealing the channels to prevent the sterile compositions from escaping; and a tab portion joining the plurality of tear-off solid closures, wherein removing the tab portion causes all of the tear-off solid closures to be removed in a single action and permit the sterile compositions housed in their respective chambers to escape through their respective angled channels and combine at a point distal from the container wherein the first and second angled channels form an angle which prevents the combined compositions from substantially contacting an outer, non-sterile surface of the container and prevents contamination to the sterile compositions, wherein the container comprises a flexible sterilizable material.

2. The container of claim 1, wherein the angled channels form an angle no greater than about 180 degrees.

3. The container of claim 1, wherein the angled channels form an angle no greater than about 60 degrees.

4. The container of claim 1, wherein the container is made of a flexible polymer selected from the group consisting of polyamides, polyesters, polyethers, polyurethanes, polyolefins, random or block copolymer thereof, or blends thereof.

5. The container of claim 1, wherein the container is made of a flexible polyolefin.

6. The container of claim 1, wherein the first and second chambers house compositions that comprise different active agents.

7. The container of claim 1, wherein the first and second chamber individually house a volume of about 0.25 cubic centimeter to about 10 cubic centimeters.

8. The container of claim 1, wherein the first chamber contains a different volume from the second chamber.

9. The container of claim 4, further comprising a third chamber within the body for containing a third sterile composition, wherein the third chamber has a third angled channel for directing the third sterile composition from the third chamber.

10. The container of claim 4, comprising a first sterile composition in the first chamber and a second sterile composition in the second chamber.

11. The container of claim 10 wherein the first and second sterile compositions are different.

12. The container of claim 1, comprising one or more pharmaceutically active compositions.

13. The container of claim 1, comprising a bronchodilator solution.

14. The container of claim 1, comprising one or more compositions.

* * * * *